US005860792A

United States Patent [19]

Marks

[11] Patent Number: 5,860,792

[45] Date of Patent: Jan. 19, 1999

[54] PORTABLE PUMP HOUSING FOR AN OPERABLE SUBMERSIBLE PUMP UNIT

[76] Inventor: Donald C. Marks, 815 W. Swamp Rd., Middlesex, N.Y. 14507

[21] Appl. No.: 636,921

[22] Filed: Apr. 24, 1996

[51] Int. Cl.[6] ..... F04B 39/06

[52] U.S. Cl. ..... 417/366; 417/371; 417/423.3; 417/423.9

[58] Field of Search ..... 417/366, 371, 417/423.3, 423.9, 423.14, 423.15

[56] References Cited

U.S. PATENT DOCUMENTS

| | | | |
|---|---|---|---|
| 2,689,670 | 9/1954 | Smith | 417/423.3 |
| 2,749,846 | 6/1956 | Karrer | 417/423.15 |
| 3,556,677 | 1/1971 | Tremain . | |
| 3,637,326 | 1/1972 | Dowell . | |
| 3,683,600 | 8/1972 | Rice . | |
| 3,736,077 | 5/1973 | Dane, Jr. | 417/424 |
| 3,748,066 | 7/1973 | Sully et al. | 417/423.3 |
| 3,764,233 | 10/1973 | Strickland | 417/371 |
| 3,992,130 | 11/1976 | Childress . | |
| 4,314,213 | 2/1982 | Phelps | 166/66 |
| 4,552,516 | 11/1985 | Stanley | 417/477 |
| 4,621,987 | 11/1986 | Spingath, Jr. | 417/313 |
| 5,336,063 | 8/1994 | Lehrke et al. . | |
| 5,392,750 | 2/1995 | Laue et al. . | |
| 5,529,462 | 6/1996 | Hawes | 417/360 |

FOREIGN PATENT DOCUMENTS

| | | | |
|---|---|---|---|
| 284909 | 1/1935 | Italy | 417/423.15 |
| 60-153491 A | 8/1985 | Japan | 417/423.3 |

*Primary Examiner*—Timothy Thorpe
*Assistant Examiner*—Cheryl J. Tyler
*Attorney, Agent, or Firm*—Cumpston & Shaw

[57] ABSTRACT

A pump enclosure assembly including a submersible pump within an elongate chamber and connected to an excess chamber having a detachable fitting extending through the access chamber to allow easy retrieval and maintenance of the pump. The pump enclosure assembly of the present invention is a sturdy, efficient, inexpensive assembly to promote the efficiency and safety of the pump itself.

21 Claims, 5 Drawing Sheets

PORTABLE PUMP HOUSING FOR AN OPERABLE SUBMERSIBLE PUMP UNIT

FIELD OF INVENTION

This invention relates to pump assemblies, and more particularly, to submersible pumps contained within a pump enclosure to allow easy installation, maintenance, and provide a stable, safe assembly system.

BACKGROUND OF THE INVENTION

Submersible pumps have been used for many years to effectively pump water or the like from one point to another. However, offshore submersible pump assemblies have been difficult to maintain and repair due to the submersible nature of the assembly. Offshore submersible pumps are subject to the daily wear and tear of use while also being exposed to the hostile underwater environment. Off shore pump assemblies for use with pumping water from underground water aquifers, are susceptible to contamination from external forces. Interference with the pump assemblies, such as human interference or natural interference such as gravel, sand and plant life, tends to wreak havoc on the pumps. The submersible pump may become trapped on the floor of the body of water or may be caught in a tow line or anchor line of a boat. In order to maintain and repair the pumps, underwater divers are sometimes used. Other retrieval means such as retrieval lines and ropes may be used but may cause further damage to the pump assembly.

Further, some prior art design of pump assemblies have tended to position or orient the discharge lines such that the discharge line rises in a vertical direction away from the pump assembly. This vertical rise of the discharge line exposes the discharge line to external factors such as boaters and sea animals which may destroy the discharge line. Some pump assemblies have inverted the position of the pump, contrary to its mechanical design, to orient the discharge line along the floor of the body of water.

In addition, the electrical combinations of prior art tend to expose the electrical connections and conductors in a dangerous manner. The risk of electric shock to the maintainer, swimmer, or boater presents a formidable threat to the individual's life.

Further, it is unknown in the prior art to construct a sealed pump assembly which utilizes the submersible pump to generate a vaccuum as a means to pump water for any application. Submersible pumps are not typically used to generate a vaccum. Such pumps are utilized to push water along, not to generate a vaccuum to pump water.

In order to overcome the aforementioned problems, many individuals have designed cumbersome, ineffective and sometimes hazardous assemblies. Therefore, there is still a long felt need for a sturdy, inexpensive pump enclosure which can withstand a sufficient pressure and allow a submersible pump to create a vacuum to pump water in a safe, effective manner.

SUMMARY OF THE INVENTION

The present invention is an enclosure for a submersible pump comprising an elongated pump chamber having an inlet end for connection to a source of liquid, the inlet end positioned so that liquid entering the chamber passes over the motor of a pump disposed in the chamber; an access chamber connected to the pump chamber; a detachable fitting extending through the access chamber for connection to a liquid outlet line; a removable access cover on the access chamber for permitting a pump to be installed in or removed from the pump chamber; and at least one supporting leg attached to the enclosure to support the pump assembly.

DETAILED DESCRIPTION OF THE INVENTION

Figure 2:
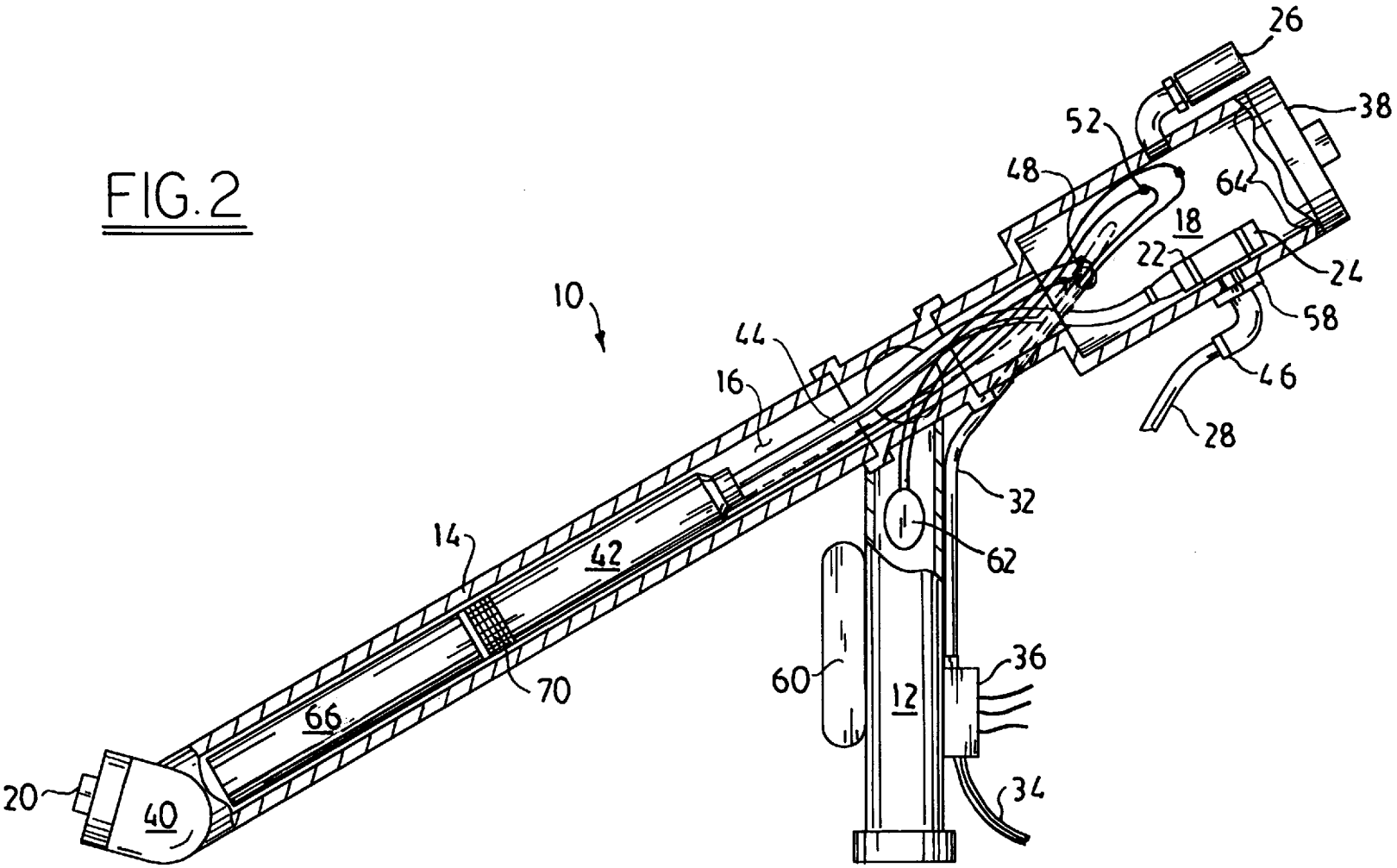
FIG. 2 is a cut away side view of the pump enclosure assembly with a portion of the chamber wall cut away.

Referring to the drawings for details of the present invention in its preferred form, the pump enclosure assembly 10 for a submersible pump is illustrated in FIG. 2. The enclosure 10 comprises an elongate pump chamber 14 having a pump cavity 16, an access chamber 18, and a spaced apart inlet end 20 for connection to a source of liquid. The inlet end 20 is positioned so that liquid entering the chamber 14 passes over the motor 66 of a pump 42 disposed in the chamber 14. An access chamber 18, having a removable access cover 38, is connected to the pump chamber 14. The removable access cover 38 permits a pump 42 to be installed in or removed from the pump chamber 14. The pump 42, preferably a 5submersible pump sold by Goulds Pumps of Seneca Falls, N.Y., lays above the motor 66 and the water intake suction strainer 70 within the pump cavity 16. At an opposite end, the pump 42 is attached to a flexible conduit 44, preferably a flexible hose. During operation, the pump 42 creates a vaccuum, thereby creating positive displacement of water, which in turn draws additional water through the inlet 20 or inlets and into the assembly 10. Preferably, the assembly 10 is a sealed unit which can support the vaccuum created by the pump 42. The structural integrity of the present invention allows the inverse use of the pump, ie. backflushing. The assembly 10 is designed such that the pump 42 may be utilizied to backflush the system. The backflushing of the system allows an individual to clean or unclog his system without disassemblying the system.

A detachable fitting 22 extends through the access chamber 18 for connection to a water outlet line 28. The detachable fitting 22 is preferably a brass pitless adapter. The detachable fitting 22 is attached to the interior of the access chamber 18 with an exterior port 58 extending through the access chamber 18. Preferably, the detachable fitting 22 includes a female dead-end port 24 which allows for the insertion of a threaded male post or pole (not shown) to be inserted to facilitate the retrieval of the pump 42 from the pump assembly 10. The detachable fitting 22 is fluidly connected to the pump 42 by the flexible conduit 44, preferably a flexible hose.

The external port 58 of the pitless adapter 22 is fluidly connected to a discharge line 28, via a quick disconnect fitting, a cam lock, or preferably a brass insert adapter and clamp 46.

The internal electrical connections 52 to the pump 42 are connected within the access chamber 18. The access chamber 18 itself has a larger internal area relative to the elongate pump chamber 14. The electrical lines are a sufficient length such that when the pump 42 is removed from the assembly 10, the electrical connections are not required to be disconnected to service the pump 42. The electrical wirings exit the access chamber 18 via an power supply port 48 and into a first conduit 32 which extends along the outside of the access chamber 18 and the support 12. The power supply port 48 is sealed with an appropriate liquid resistant material 72 such as a duct sealing compound, jell, wax or preferably a sealant such as System 2000, available from OEM Structural Repair and Sealing Products, a division of OATEY Company of Cleveland, Ohio. The first conduit 32 connects into a junction box 36 located on the exterior of the support leg 12. In an opposite direction, a second conduit 34 extends along the exterior of the support leg 12 and connects in the junction box 36; thereby facilitating a juncture between an external electrical source running through conduit 34 and the electrical lines contained within conduit 32. The conduit 32 is sealed, except for the electrical lines contained therein, from any external environment. The sealing of the conduit 32 promotes the generation of vacuum by the pump 42 during operation. The sealed conduits stop the influx of unwanted matter, such as water, air or debris, from entering the assembly 10.

Preferably, the access chamber 18 includes a relief check valve 26 which is connected to the access chamber 18 and allows air to be vented in a one way direction out of the pump enclosure assembly 10 to help prevent an air lock from disrupting the pump 42. The relief check valve is disabled when backflushing is undertaken. The relief check valve 26 may be replaced with a sealing plug, stop valve or other appropriate devices (not shown) when backflushing is undertaken. Preferably, a flow restricting fitting 74 is fluidly connected to the relief check valve 26 to restrict the flow of liquid through the check valve 26 to promote a unidirectional flow of liquid back to the inlet 20.

The access chamber 18 further comprises a removable access cover 38 which is preferably threadedly insertable and removable from the access chamber 18 and access port 64. The removable access cover 38 allows easy entry into and closure of the access chamber 18. The removable access cover 38 allows an individual to enter the interior of the access chamber 18 to work on the electrical connections 52, removal of the pump 42, removal of the detachable fitting 22, and other maintenance repairs.

Figure 1:
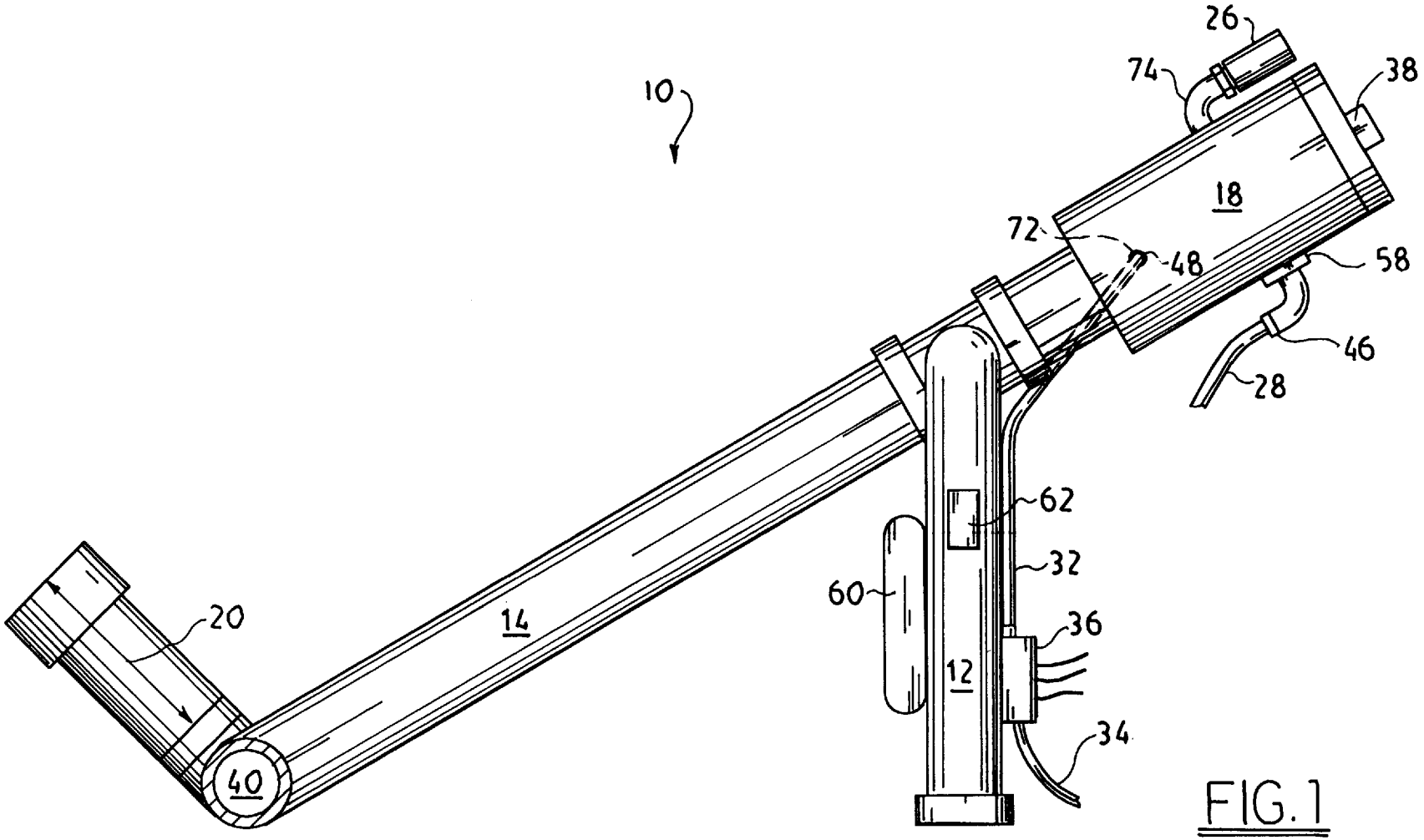
FIG. 1 is an exterior side view of the pump assembly according to the present invention.
Figure 3:
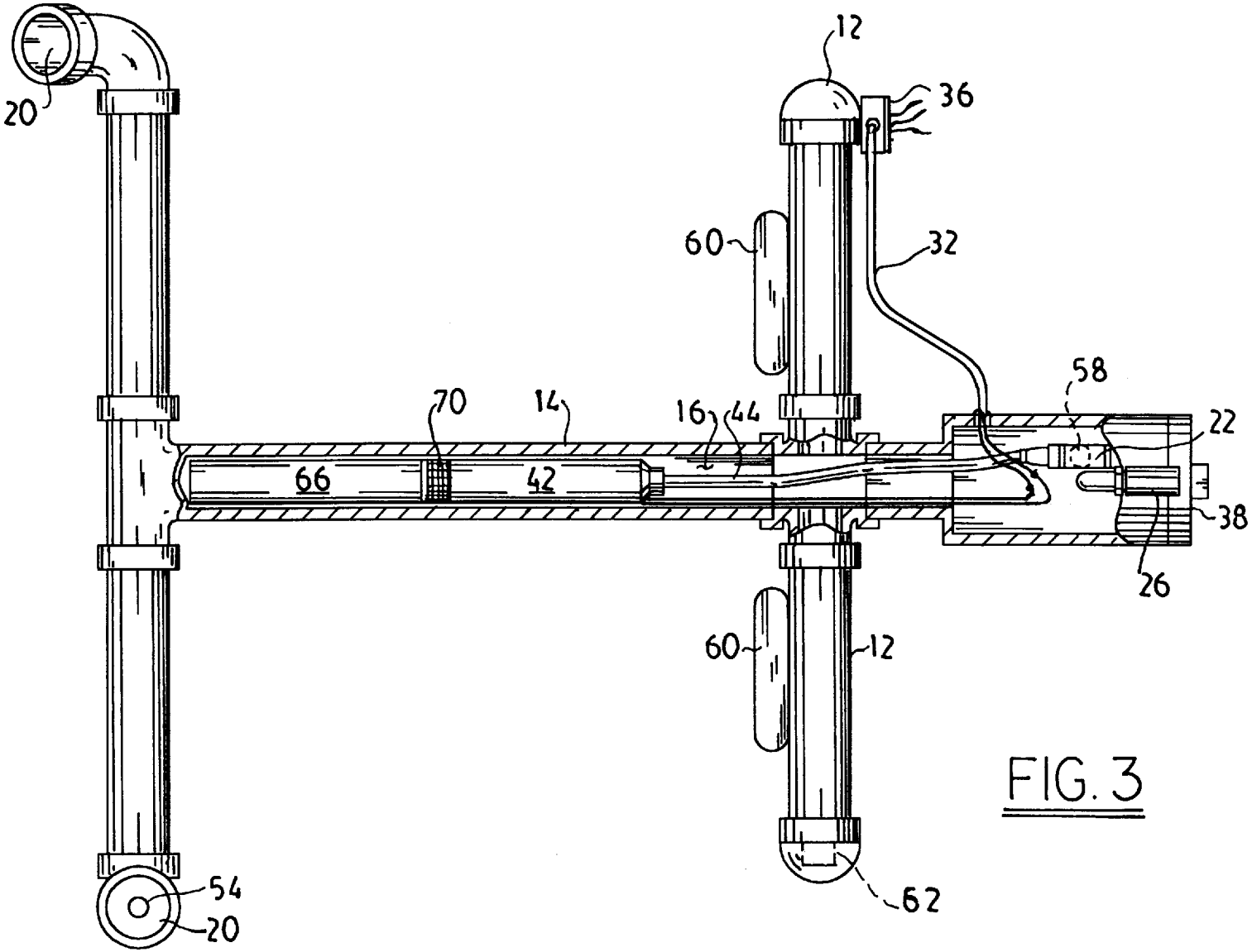
FIG. 3 is an overhead view of the pump enclosure assembly with a portion of the assembly cut away.

As shown in FIG. 3, the inlet end 20 comprises at least one intake port 54. Preferably a brass insert adapter and clamp connects an external filter or other pipe or hose (not shown) to the intake port 54. As shown in FIGS. 1 and 2, the inlet end 20 may be pivotally attached to the pump chamber 14 by a pivot mechanism 40 which allows the inlet end 20 to be adjusted according to the desired or required dimensions of the pump enclosure assembly 10 or the terrain of the body of water in which the pump enclosure assembly 10 is located.

The support leg 12 comprises at least one vertical leg, preferably two vertical legs which are positioned at the sides of the elongate pump chamber 14. The support legs 12 can also be pivotally manipulated to allow the angle of the pump housing to be changed. Preferably, the assembly 10 is positioned such that the access chamber 18 is disposed above the inlet 20. The pump chamber 14 may be positioned at an angle of approximately between 0° to 90° from the floor of the water source. Preferably, the pump chamber 14 will be positioned at an approximate angle range of between 45° and 90° relative to the floor of the water source.

The pump assembly enclosure 10 may further include at least one ballast container 60 within or attached to the assembly 10, preferably the support leg 12. The ballast container 60 will provide flotation for the assembly 10. A low pressure line may be connected to the ballast container 60 to provide air to inflate the ballast container when necessary to float the assembly 10 to the surface of the water. In order to return the assembly 10 to its desired position on the floor of the water source, water may be allowed to reenter the ballast container 60 to provide the necessary weight to sink the assembly 10.

For further safety enhancement, a pill switch 62 may be attached to the assembly 10 to facilitate the detection of an imbalance or disturbance in the position of the assembly 10. The pill switch, 62, well known in the electromechanical art, operatively communicates a signal to the operator or maintainer of the assembly 10 to notify the individual of an imbalance or disturbance in the physical positioning of the assembly 10.

Figure 4:
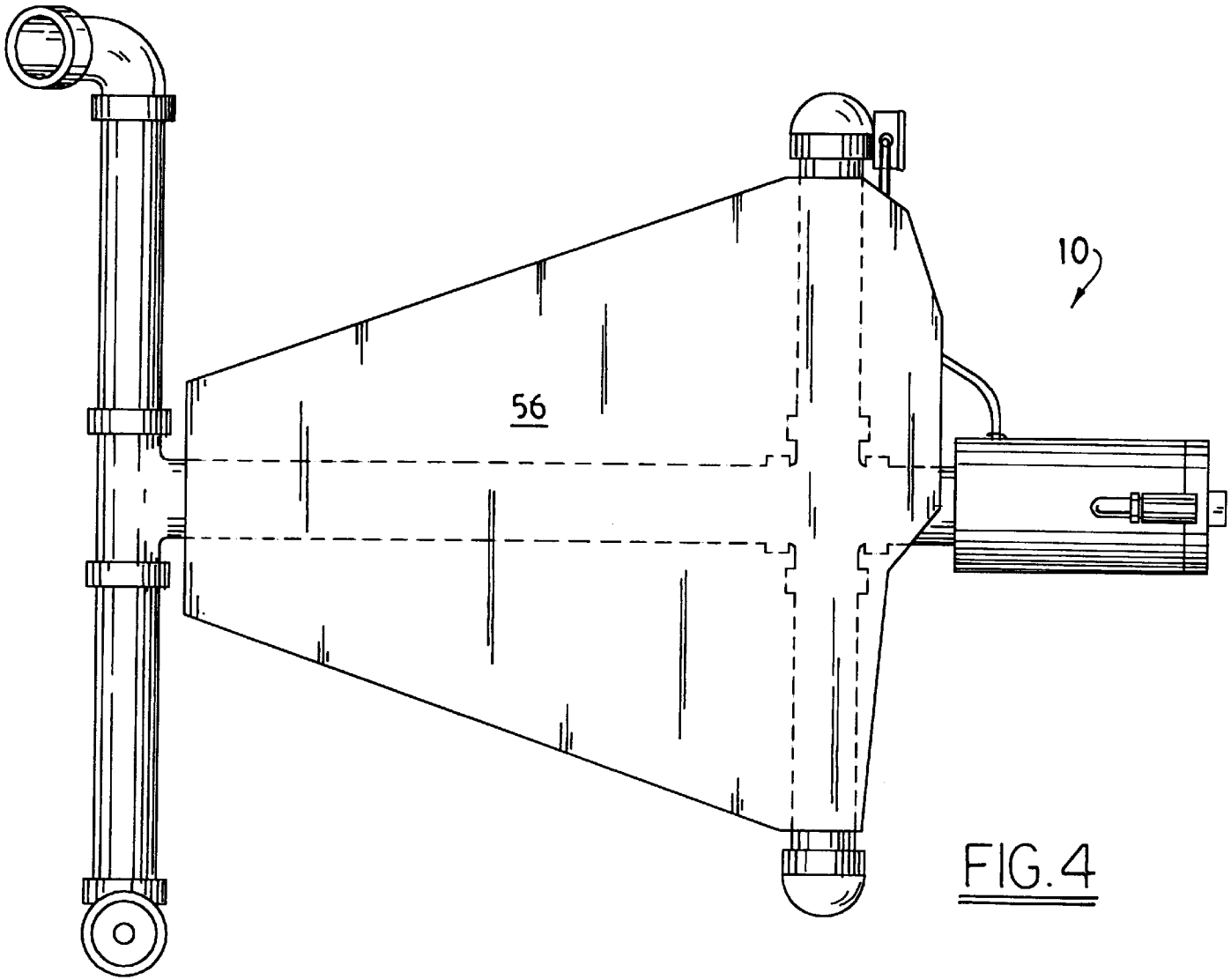
FIG. 4 is an overhead view of the pump assembly with the cover shield.
Figure 5:
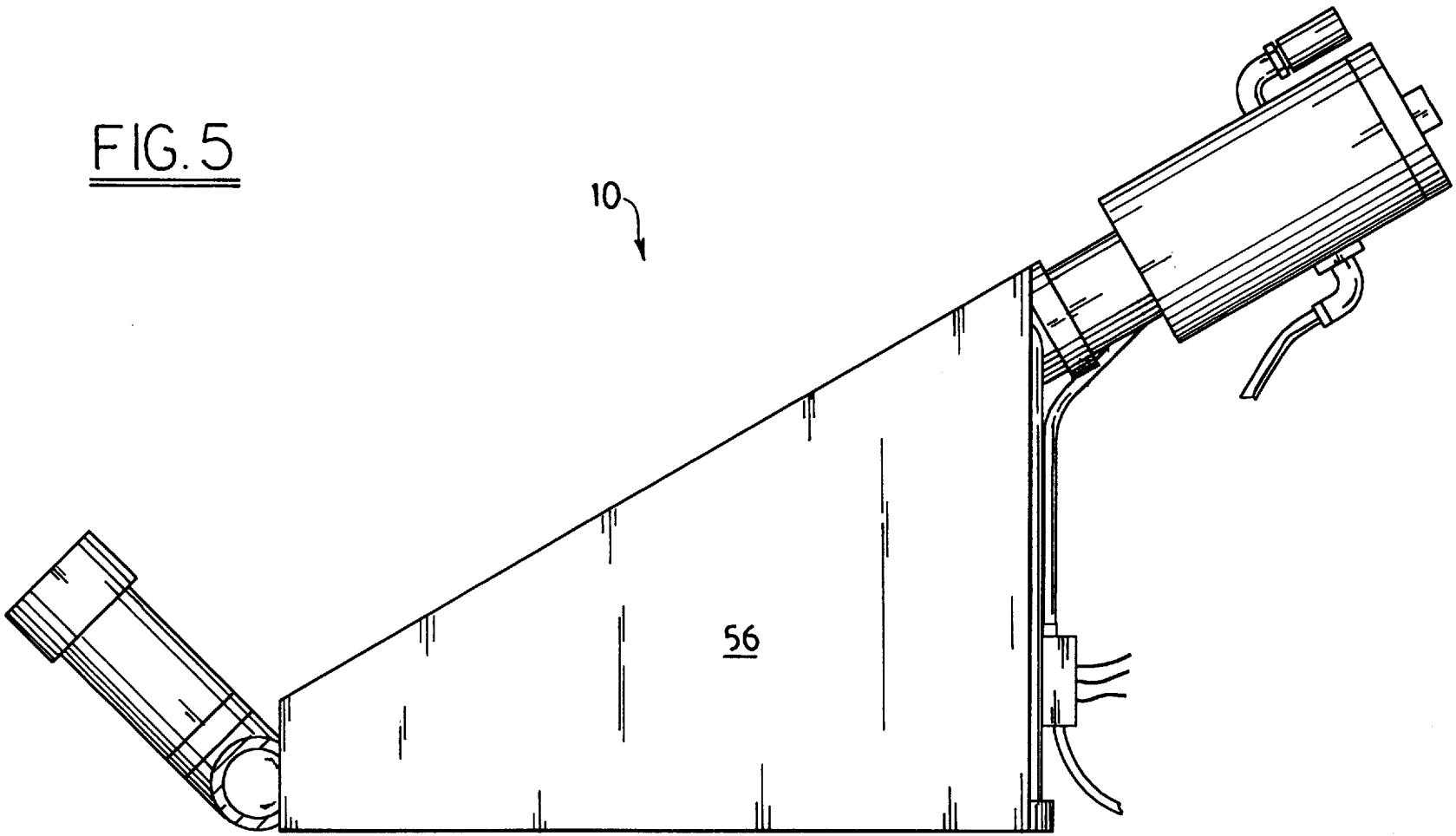
FIG. 5 is a side view of the the pump assembly with the cover shield.

As shown in FIGS. 4 and 5, the pump assembly 10 further includes a cover shield 56, which is positioned over the entire pump enclosure assembly 10 to prevent any external interference or hooking onto the pump enclosure assembly 10. Many boaters or swimmers may inadvertently hook on to the pump enclosure assembly 10, thereby disturbing its desired position. Further, the cover shield 56 may help prevent sand, dirt or other extraneous material from accumulating on the pump assembly itself. The cover shield 56, pump chamber 14, the support legs 12, the inlet end 20, the access chamber 18 and access cover 38 may be comprised of any non-conductive material, such as plastic, preferably polyvinyl chloride (PVC).

Modifications, changes and improvements to the forms of the invention herein discloses, describe, an illustrated may occur to those skilled in the art who come to understand the principals and precepts thereof. Accordingly, the scope of the patent to be issued hereon should not be limited to the particular embodiments of the inventions set forth herein, but rather should be limited by the advance by which the invention has promoted the art.

I claim:

1. An assembly for a submersible pump comprising:

(a) an elongated pump chamber having an inlet end for connection to a source of liquid, the inlet end positioned so that liquid entering the chamber passes over the motor of a pump disposed in the chamber;

(b) an access chamber having an access port sized to permit passage of a pump in an operable configuration connected to the pump chamber;

(c) a detachable fitting extending through the access chamber for connection to a liquid outlet line;

(d) an access cover removably attached on the access chamber, for permitting a pump to be installed in or removed from the pump chamber; and (e) at least one supporting leg attached to the assembly for supporting the pump.

2. The assembly of claim 1 further comprising a check valve attached to the access chamber.

3. The assembly of claim 1 in which the detachable fitting comprises a pitless adapter having an external port and a female dead end port.

4. The assembly of claim 1 further comprising a sealed first conduit extending from the access chamber.

5. The assembly of claim 1 in which the assembly is sealed from the external environment.

6. The assembly of claim 1 further comprising a second conduit extending along the supporting leg to a power source.

7. The assembly of claim 1 further comprising a junction box affixed on the supporting leg connecting the first and second conduits.

8. The assembly of claim 1 further comprising a cover shield which fits over the assembly.

9. The assembly of claim 1 in which the inlet comprises at least one intake port.

10. The assembly of claim 1 further comprising at least one pivotable connection between the inlet and the assembly.

11. The assembly of claim 8 in which the assembly, pump chamber, access chamber, access cover, cover shield and support leg are comprised of a non-conductive material.

12. The assembly of claim 1 in which the supporting leg faces a downwardly direction and the inlet faces an upwardly direction.

13. The assembly of claim 1 in which the detachable fitting is a brass pitless adapter.

14. The assembly of claim 1 further comprising a quick disconnect fitting attached to the detachable fitting.

15. The assembly of claim 14 further comprising a discharge line fluidly connected to the quick disconnect line.

16. The assembly of claim 1 further comprising at least one ballast container attached to the assembly.

17. The assembly of claim 1 further comprising an intake suction strainer.

18. The assembly of claim 1 further comprising a motor disposed between the water intake suction strainer and the inlet such that liquid flows over the motor.

19. The assembly of claim 1 in which the access chamber is disposed above the inlet end.

20. The assembly of claim 1 in which a flow restricting fitting is fluidly connected to a relief check valve, the check valve being attached to the access chamber.

21. A new pump assembly for operable retaining a pump and a motor, comprising:

(a) a housing having an inlet end, said inlet end positioned so that liquid entering a chamber passes over the motor of a pump disposed in the chamber;

(b) an outlet end spaced from the inlet end;

(c) an access port spaced from the inlet end;

(d) a power supply port intermediate the inlet end and the access port;

(e) the access port sized to permit the pump and the motor to pass therethrough;

(f) the housing configured to locate the pump and the motor adjacent the inlet end in an operable configuration and allow passage of the pump and motor through the access port in a serviceable configuration; and (g) at least one supporting leg attached to the assembly for supporting the pump.

* * * * *